US008474611B2

(12) United States Patent
Marco

(10) Patent No.: US 8,474,611 B2
(45) Date of Patent: Jul. 2, 2013

(54) MULTIPLE APERTURE DOSING CLOSURE SYSTEM

(76) Inventor: Saulle Marco, Carpiano (IT)

( * ) Notice: Subject to any disclaimer, the term of this patent is extended or adjusted under 35 U.S.C. 154(b) by 8 days.

(21) Appl. No.: 13/144,393

(22) PCT Filed: Apr. 8, 2009

(86) PCT No.: PCT/EP2009/002611

§ 371 (c)(1),
(2), (4) Date: Jul. 13, 2011

(87) PCT Pub. No.: WO2010/081495

PCT Pub. Date: Jul. 22, 2010

(65) Prior Publication Data

US 2011/0272301 A1 Nov. 10, 2011

(30) Foreign Application Priority Data

Jan. 14, 2009 (WO) ..... PCT/EP2009/000226

(51) Int. Cl.
*B65D 25/08* (2006.01)

(52) U.S. Cl.
USPC ..... 206/219; 206/222

(58) Field of Classification Search
USPC ..... 206/219, 222, 221; 215/DIG. 8; 222/83, 222/81
See application file for complete search history.

(56) References Cited

U.S. PATENT DOCUMENTS

| | | | | |
|---|---|---|---|---|
| 3,439,823 | A * | 4/1969 | Bruno | 215/DIG. 8 |
| 4,386,696 | A * | 6/1983 | Goncalves | 206/219 |
| 4,917,237 | A * | 4/1990 | Groves et al. | 206/219 |
| 5,419,445 | A * | 5/1995 | Kaesemeyer | 215/DIG. 8 |
| 5,772,017 | A | 6/1998 | Kang | |
| 6,056,142 | A * | 5/2000 | Elliott | 222/83 |
| 6,840,373 | B2 * | 1/2005 | Gibler et al. | 206/219 |
| 6,921,087 | B2 * | 7/2005 | Takahashi et al. | 206/219 |
| 7,032,745 | B2 * | 4/2006 | Saulle | 206/219 |
| 7,055,684 | B2 * | 6/2006 | Anderson | 206/219 |
| 7,854,104 | B2 * | 12/2010 | Cronin et al. | 206/219 |
| 7,980,424 | B2 * | 7/2011 | Johnson | 222/83 |

FOREIGN PATENT DOCUMENTS

| | | |
|---|---|---|
| EP | 0 599 189 A | 6/1994 |
| EP | 1 550 619 | 7/2005 |
| WO | 2006/050538 A | 5/2006 |
| WO | 2007/006414 | 1/2007 |

* cited by examiner

*Primary Examiner* — Andrew Perreault
(74) *Attorney, Agent, or Firm* — McGlew and Tuttle, P.C.

(57) ABSTRACT

A closure with an integrated dosing cap (1), comprising an upper part (6), a body (2) with a threaded closure (9) having a bottom (3). Closed by a closing seal (5) fixed to the lower end of the body (2) and easily removable in response to axial pressure (F) exerted on the upper part (6) of the closure dosing cap, thus creating 2 or more individual openings at the bottom (3).

20 Claims, 1 Drawing Sheet

12
9
1
6
9
11
11
2
C
10
21
8
8
3
3
A
A
4
4
5
7
21

3
2
A
5
4
21

F
F
F 1
12
9
9
2
11
10
11
C
3
3
8
7
8
45.00°
45.00°
5
5

10
4
4
7
7
8
8
A
A
3
3

MULTIPLE APERTURE DOSING CLOSURE SYSTEM

CROSS REFERENCE TO RELATED APPLICATIONS

This application is a United States National Phase application of International Application PCT/EP2009/002611 and claims the benefit of priority under 35 U.S.C. §119 of PCT/EP2009/000226 filed Jan. 14, 2009, the entire contents of which are incorporated herein by reference.

FIELD OF THE INVENTION

The present invention refers to a bottle closure system with an incorporated barrierized dispensing cap having a multiple dispensing aperture.

BACKGROUND OF THE INVENTION

Dosing caps are widely used in many technological sectors, particularly in the pharmaceutical sector, to keep separate until the time of use a first component contained in the cap, and a second component contained in the bottle.

Probiotics are an example of an active ingredient. These are live micro-organisms that are normally present in our stomach and play an important role in keeping our bodies healthy and functional. Probiotics means pro-life and these are prescribed to be administered on a daily basis during an Antibiotics (meaning anti-life) medicines therapy. Well probiotics are created in culture chambers along with water and heat. Once the probiotic culture has grown and multiplied to a sufficient number count, it is hibernated through a drying procedure which prevailes the probiotic from water, this procedure freezes their life activity from expiring. Probiotics will regain life activity once they are rehydrated during activation via dosing closure before consumption; It is thus fundamental that probiotics be stored in a dry compartment or dry chamber until time of use. The use of an adequate barrierized dosing closure is thus fundamental cause it keeps the probiotic safe from dying out.

Reducing the air space between the dispensing cap and the liquid level in the bottle may help reduce the build up of water moisture by volume which is present in the bottle, a major cause of water vapor permeation into the dispensing caps. The space between the dosing cap and the liquid level is determined by the distance the dosing cap derived parts travel into the bottle once it is activated. This is so, because the dosing cap must be fully activated before getting the powder ingredients wet.

The ideal dosing cap is that which can significantly reduce the distance an opening travels into the bottle by proportions to other types of dosing caps. This goal has been achieved by the multi aperture dosing closure system. Where the aperture of the dosing has been split in half, which shortens the opening arc of previous dosing caps too over 50%. This means less space is required between the bottom of the dosing closure system and the liquid in the bottle; which means less air being pumped into the bottle cause of gas seeping and less activation maneuver required by the consumer.

Many types of dosing closures are known to the art; some closures are cited in which the bottom membrane is ruptured by a body having a slanting profile or so called oblique neck and those (described, for example, in patents EP 1 550 619 and WO 2007/006414 in the name of the applicant) which compromises a rod-shaped body placed inside the dosing closure, suitable to rupture the closing membrane in response to an axial pressure exerted on the upper part of the dosing closure. Another example of dosing closure is described in EP 0 599 189.

Dosing closures have evolved significantly over the last 6 years in regards to safe consumer design and improving closure barrier properties; though sometimes the outcome is a better product but more complicated to manufacture, because of its complexity and equipment required for assembly in order to give the closure a complete technological feature in terms of barrierizarion properties.

SUMMARY OF THE INVENTION

The object of the present invention is to provide a dosing closure that maximizes content capacity in respect to the applicants previous multiple patents and but not limited to its own patents. The new and improved design improves cycle time productivity and reduces ecological impact and this is achieved by simply transforming a single aperture dosing chamber closure into a multiple aperture dispensing closure, presenting a multiple activation. In particular this new closure is composed of two molded parts; instead of three or more parts as many competitors currently market.

The object is achieved with a dosing closure as featured in the present invention.

In particular, the invention concerns a closure dosing cap, comprising an upper part, a body with a threaded closure having a bottom, in that the bottom is divided by a splitter and that the bottom is connected to the stem; between the lower end of the body and the bottom, are two separated independent gaps closed by a closing seal fixed to the lower end of the body and easily removable in response to axial pressure exerted on the upper part of the closure dosing cap whom is connected to the bottom via intersection of the border-rim with legs, wherein border-rim intersects with legs having, for example but not limited to, a v or u shaped profile.

In a preferred embodiment of the invention, the closure dosing cap is characterized in that the splitter intersects the bottom creating (for example but not limited too) a bilateral bottom and therefore the closure dosing cap to have a multiple individual apertures at the bottom of the closure dosing cap bottom has a leg on the two opposite bottoms.

In another preferred embodiment of the invention, the closure dosing cap is made of high-density polyethylene or any other polymer resin with good resistance to water vapor permeability e.g. polypropylene (PP) and polyvinyl chloride (PVC) etc.

In another preferred embodiment of the invention, the closure dosing cap provides a closing seal consisting of any multilayer film with oxygen and humidity barrier properties.

In another preferred embodiment of the invention, the closure dosing cap provides a closing seal which is welded to the end of the body.

In another preferred embodiment of the invention, the closure dosing cap comprises a closing seal which is glued to the end of the body.

In another preferred embodiment of the invention, once the seal is removed the ingredients in the closure dosing cap are released through the two independent gaps as seen in FIG. 3.

In another preferred embodiment of the invention, the closure dosing cap is comprised of an inner thread designed to allow the closure dosing cap to be screwed onto a bottle.

In another preferred embodiment of the invention, each bottom will perform a rotation on its stem axis.

In another preferred embodiment of the invention, the gap may be closed by a pressure lid like for example the lids applied on the tennis ball tube container.

In another preferred embodiment of the invention, the gap may be closed by bottom by intersection of bottom into the inner side of the lower end of body.

In another preferred embodiment of the invention, the gap may be closed by bottom by overlapping over the body.

In another preferred embodiment of the invention, the upper body part is sealed by a peelable closing seal.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
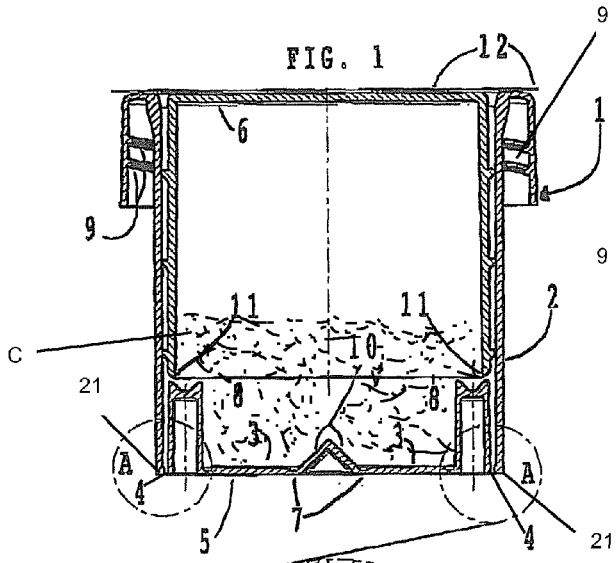
FIG. 1 is a diagrammatic sectional view of a dosing closure produced according to the invention.

In the appended figures corresponding elements will be designated by the same reference numerals.

The present invention refers to a bottle closure system with an incorporated dispensing barrierized dispensing cap having a multiple dispensing aperture, the closure made of high density material, which comprises a upper part, a body and a bottom and which has, between the lower end of the body and the bottom, two or more gaps closed by a closing seal, fixed to the lower end of the body and easily removable. The closure dosing cap has a connection part for the connection to a bottle to be closed. The connection part is threaded with inner thread 9 for screwing the closure dosing cap onto the bottle.

Figure 2:
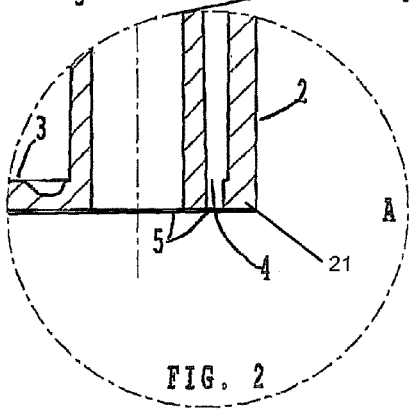
FIG. 2 is a diagrammatic, enlarged, view of the detail designated by A in FIG. 1.

FIG. 1 shows diagrammatically, in section, a symmetrical dosing cap 1 produced according to the invention; visible in FIG. 1 are the body 2, the bottom 3, 3 and the gaps 4 (as illustrated on the right and left corner sides circled and marked with letter A, more visible in the enlarged detail of FIG. 2—since the design is symmetrical we only enlarged the detail on the right side) present between the lower end 21 of the body 2 and the bottom 3, 3 and closed by the closing seal 5, welded or glued to the lower end 21 of the body 2 and easily removable in response to axial pressure F (FIG. 3) exerted on the upper part 6 of the dosing cap 1.

In the embodiment described herein by way of non-limiting example, the dosing closure cap 1 is derived from that described, for example, in patent EP 1550619 in the name of Lorenzo Saulle father of the Applicant, from which it differs in that the cap has a symmetrical design which makes this new cap different and superior in that this new closure system has two dispensing apertures on the bottom instead of one as described in the previous patents. This new dosing cap differs for the presence of two gaps 4 and of the closing seal 5 but, without departing from the scope of the invention, the dosing cap 1 can be derived (by providing the gap 4 and adding the closing seal 5) from another per se known dosing cap. The dosing cap has been integrated with a standard closure cap into one piece as illustrated in FIG. 1 body 2.

The dosing cap 1 is made of a high density plastic material (for example, high density polyethylene): the closing seal 5 preferably consists of a thin sheet of aluminum or other per se known material, easily tearable and/or detachable from the body 2 in response to an axial pressure F (FIG. 3) applied on the upper part 6 of the dosing cap.

The bottom 3, 3 is split by splitter 10 connected to the hollow body 2 in correspondence of the lower end 21. Each split bottom portion 3 is connected to the splitter by a stem 7 and is able to rotate on its stem axis. Each split bottom has a leg 8. Therefore, the bottom 3, 3 is advantageously joined to the symmetrical body 2 of the dosing cap 1 the stem 7 which, which prevents both split bottom portions 3 from dropping, after breaking of the seal 5, into the bottle (omitted in the appended figures to simplify the graphic representation) in the neck of which the dispensing cap closure protrudes.

FIG. 2 shows diagrammatically, enlarged, the detail designated by A in FIG. 1 and makes it possible to see the gaps 4 present between the bottom 3 of the closing cap and the lower part of the body 2, and the closing seal 5 which closes the two separated independent gaps 4.

Figure 3:
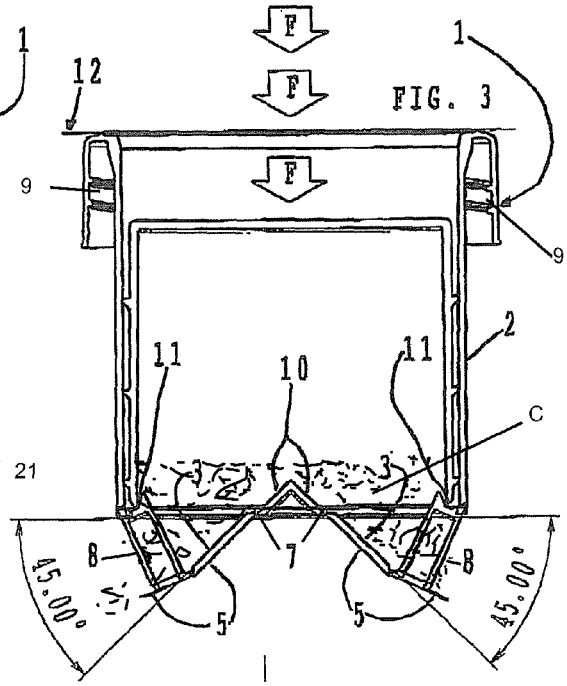
FIG. 3 is a diagrammatic sectional view of the dosing closure of FIG. 1 opened by axial pressure exerted on its upper part.
Figure 4:
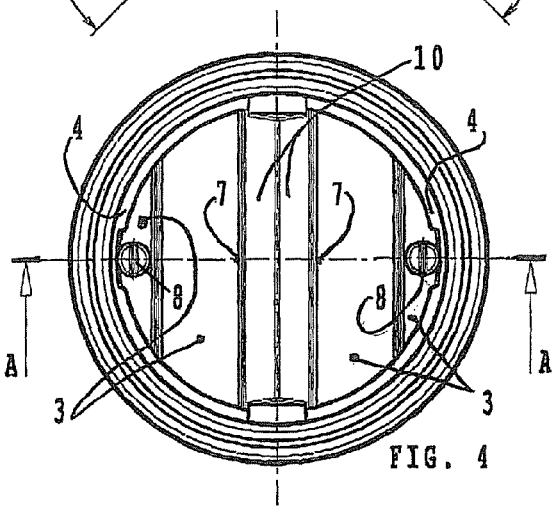
FIG. 4 is a bottom view of the dosing closure of the present invention.

FIG. 3 shows diagrammatically, in section, the dosing closure cap of FIG. 1. opened by the axial pressure F exerted on the upper part 6 thereof which, by sliding in the body 2, has caused, by means of the leg in form of a rod-shaped body 8 detachment or rupture of the seal 5 and opening of the bottom 3, which remains attached to the body 2 by means of the stem 7. The upper part 6 has a lower end 11 that engages the body 8. Once the seal 5 is removed the ingredients C in the closure dosing cap are released through the two independent gaps as shown in FIG.3. The upper body part of body 2 is sealed by a peelable closing seal 12.

Without departing from the scope of the invention, an expert in the field can make to the dosing closure cap of high density plastic material, provided with a closing seal, forming the subject matter of the present invention all those changes and improvements suggested by his experience and by the natural evolution of the art.

While specific embodiments of the invention have been described in detail to illustrate the application of the principles of the invention, it will be understood that the invention may be embodied otherwise without departing from such principles.

The invention claimed is:

1. A closure dosing cap, comprising:

a hollow body for connecting to a bottle to be closed, said hollow body comprising a lower end and a bottom, said bottom being split by a splitter connected to said hollow body to provide at least two split bottom portions, each of said two split bottom portions being connected to said splitter by a stem, each of said two split bottom portions comprising a leg, each of said two split bottom portions being rotatable about a stem axis, wherein two or more separated independent gaps are provided between said lower end of the body and the bottom, said two or more separated independent gaps being closed by a closing seal fixed to the lower end of the body;

a further body comprising an upper part and a lower border-rim, said further body being slidable in said hollow body such that said upper part is connected to said bottom via intersection of said border-rim with each said leg, said closing seal being removable from said lower end of said hollow body in response to axial pressure exerted on the upper part such that said upper part slides in said hollow body and each of said two split bottom portions rotates about said stem axis via intersection of said border-rim with each said leg to one of detach and rupture said closing seal and open each of said two split bottom portions, each of said two split bottom portions being attached to said hollow body via said stems connected to said splitter.

2. A closure dosing cap as in claim 1, wherein one of said split bottom portions is opposite another one of said split bottom portions, the splitter intersecting the bottom creating a bilateral opposite bottom made by said two split bottom portions, providing multiple individual apertures at the bottom.

3. A closure dosing cap as in claim 1, wherein the closure dosing cap is made of high-density polyethylene or any other polymer resin with good resistance to water vapor permeability.

4. A closure dosing cap as in claim 1, wherein the closing seal is welded to the lower end of the body.

5. A closure dosing cap as in claim 1, wherein the closing seal is glued to the lower end of the body.

6. A closure dosing cap as in claim 1, wherein once the seal is removed the ingredients in the closure dosing cap are released through at least the two or more independent gaps.

7. A closure dosing cap as in claim 1, wherein the closure dosing cap is comprised of an inner thread designed to allow the closure dosing cap to be screwed onto a bottle.

8. A closure dosing cap as in claim 1, wherein each of said two bottom portions rotates about said stem axis.

9. A closure dosing cap as in claim 1, wherein the gap is closed by a pressure lid.

10. A closure dosing cap as in claim 1, wherein the gap is closed by the bottom by intersection of the bottom into an inner side of the lower end of the hollow body.

11. A closure dosing cap as in claim 1, wherein the gap is closed by the bottom by overlapping over the hollow body.

12. A closure dosing cap as in claim 1, wherein the upper body part is sealed by a peelable closing seal.

13. A closure dosing cap as in claim 1, wherein said leg has a v or u shaped profile for intersecting with said border-rim.

14. A closure dosing cap as in claim 3, wherein said other polymer resin is one of polypropylene (PP) and polyvinyl chloride (PVC).

15. A closure dosing cap as in claim 9, wherein said pressure lid is a lid applied on a tennis ball tube container.

16. A closure dosing cap as in claim 1, wherein said closure dosing cap is composed of only two molded parts.

17. A closure dosing cap as in claim 1, wherein said hollow body and said further body are two molded parts, said closure dosing cap being composed of only said two molded parts.

18. A closure dosing cap, comprising:

a hollow body comprising a means for connecting said hollow body to a bottle, said hollow body comprising a lower end, a splitter, a first stem, a second stem and a bottom, said bottom comprising a first bottom portion and a second bottom portion, said first bottom portion being located on one side of said splitter, said second bottom portion being located on another side of said splitter, said first bottom portion being connected to said splitter via said first stem, said second bottom portion being connected to said splitter via said second stem, said first bottom portion comprising a first bottom portion leg, said second bottom portion comprising a second bottom portion leg, said lower end of said body and said bottom defining at least a first gap and a second gap, said first gap being located at a spaced location said second gap;

a closing seal fixed to the lower end of the body;

a further body comprising an upper part and a lower border-rim, said further body being in sliding contact with said hollow body such that said further body is movable from a first position to a second position, said lower border-rim being located at a spaced location from said first bottom portion leg and said second bottom portion with said further body in said first position, said lower border-rim engaging said first bottom portion leg and said second bottom portion leg with said further body in said second position such that said first bottom portion rotates about a first stem axis of said first stem and said second bottom portion rotates about a second stem axis of said second stem, wherein said closing seal is one of detached and ruptured and said first bottom portion and said second bottom portion are in an open position with said further body in said second position, said first bottom portion remaining connected to said splitter via said first stem and said second bottom portion remaining connected to said splitter via said second stem with said further body in said second position.

19. A closure dosing cap in accordance with claim 18, wherein said first bottom portion and said second bottom portion are substantially perpendicular to said further body with said further body in said first position, said first bottom portion and said second bottom portion being at an angle relative to said further body with said further body in said second position, said angle not being equal to zero.

20. A closure dosing cap, comprising:

a hollow body for engaging a container, said hollow body comprising a lower end, a splitter, a first stem, a second stem and a bottom, said bottom comprising a first bottom portion and a second bottom portion, said first bottom portion being located on one side of said splitter, said second bottom portion being located on another side of said splitter, said first bottom portion being pivotably connected to said splitter via said first stem such that said first bottom portion is movable with respect to said splitter, said second bottom portion being pivotably connected to said splitter via said second stem such that said second bottom portion is movable relative to said splitter, said first bottom portion comprising a first bottom portion leg, said second bottom portion comprising a second bottom portion leg;

a closing seal;

a further body comprising an upper part and a lower border-rim, said further body being in sliding contact with said hollow body such that said further body is movable from a first position to a second position, wherein at least a portion of said lower end and at least a portion of said first bottom portion leg define a first gap with said further body in said first position and at least another portion of said lower end and at least a portion of said second bottom portion leg define a second gap with said further body in said first position, said first gap being located at a spaced location from said second gap, said closing seal closing said first gap and said second gap with said further body in said first position, said lower border-rim being located at a spaced location from said first bottom portion leg and said second bottom portion with said further body in said first position, said lower border-rim engaging said first bottom portion leg and said second bottom portion leg with said further body in said second position such that said first bottom portion pivots about a first stem axis of said first stem and said second bottom portion pivots about a second stem axis of said second stem, wherein said closing seal is one of detached and ruptured and said first bottom portion and said second bottom portion are in an open position with said further body in said second position, said first bottom portion remaining connected to said splitter via said first stem and said second bottom portion remaining connected to said splitter via said second stem with said further body in said second position, said first gap defining at least a portion of a first fluid flow path and said second gap defining at least a portion of a second fluid flow path with said further body in said second position.

* * * * *